US006558304B1

(12) United States Patent
Bardon et al.

(10) Patent No.: US 6,558,304 B1
(45) Date of Patent: May 6, 2003

(54) APPARATUS FOR RESTORING THE BALANCE OF THE HUMAN BODY

(76) Inventors: Alain Bardon, 27 Rue Simone Abat, 26100 Romans (FR); Louis-Paul Guitay, 7 Avenue de la Gare, 26760 Monteleger (FR); Gianfranco Tudico, Quartier le Prat, 26500 Bourg les Valence (FR)

( * ) Notice: Subject to any disclaimer, the term of this patent is extended or adjusted under 35 U.S.C. 154(b) by 0 days.

(21) Appl. No.: 09/529,522

(22) PCT Filed: Oct. 13, 1998

(86) PCT No.: PCT/FR98/02150

§ 371 (c)(1),
(2), (4) Date: Apr. 13, 2000

(87) PCT Pub. No.: WO99/19028

PCT Pub. Date: Apr. 22, 1999

(30) Foreign Application Priority Data

Oct. 14, 1997 (FR) ..... 97 13071

(51) Int. Cl.[7] ..... A63B 22/14
(52) U.S. Cl. ..... 482/147; 482/148; 602/32
(58) Field of Search ..... 482/13, 69, 143–147; 602/32

(56) References Cited

U.S. PATENT DOCUMENTS

| | | | | | |
|---|---|---|---|---|---|
| 864,188 | A | * | 8/1907 | Patterson | 155/23 |
| 2,240,407 | A | * | 4/1941 | Masters | 272/57 |
| 2,478,004 | A | * | 8/1949 | Newell | 155/17 |
| 2,812,010 | A | * | 11/1957 | Abdallah | 155/23 |
| 2,827,894 | A | * | 3/1958 | Meyers | |
| 4,313,603 | A | * | 2/1982 | Simjian | 272/146 |
| 4,898,378 | A | * | 2/1990 | Edwards et al. | 272/63 |
| 4,930,771 | A | * | 6/1990 | Wilson | 482/146 |
| 5,409,452 | A | * | 4/1995 | Aversano | 602/32 |
| 5,658,245 | A | * | 8/1997 | McGinnis et al. | 602/32 |
| 5,662,560 | A | * | 9/1997 | Svendsen et al. | 482/69 |
| 5,695,432 | A | * | 12/1997 | Soderlund | 482/69 |
| 5,704,881 | A | * | 1/1998 | Dudley | 482/69 |
| 5,941,807 | A | * | 8/1999 | Cassidy et al. | 482/146 |
| 6,176,817 | B1 | * | 1/2001 | Carey et al. | 482/146 |

FOREIGN PATENT DOCUMENTS

EP 0274312 A2 * 12/1987

* cited by examiner

*Primary Examiner*—Nicholas D. Lucchesi
*Assistant Examiner*—Lori Baker Amerson
(74) *Attorney, Agent, or Firm*—Heslin Rothenberg Farley & Mesiti P.C.; Victor A. Cardona, Esq.

(57) ABSTRACT

The invention concerns an apparatus for restoring the balance of the human body, consisting essentially of a platform (2) for supporting the subject to be treated and capable of being actuated with an oscillating movement. The invention is characterized in that said platform is power-driven and receives its oscillating movement about a central support axis (6), movement associated with a rotational reciprocating movement, the amplitude and the speed of both the oscillation and the rotation being adjustable and capable of being varied while the apparatus is being used.

13 Claims, 5 Drawing Sheets

APPARATUS FOR RESTORING THE BALANCE OF THE HUMAN BODY

The present invention relates to an improved apparatus for restoring the balance of the human body.

Such balance-restoring, required for many reasons, entails the performing of corrective and rehabilitation operations that could be classified as "general biomechanics". Such operations are needed, in particular, in the case of immobility of the pelvic girdle, the shoulder girdle and the entire spinal column. They have also to be performed when the sacrum is being pushed back into place with respect to the iliac bones, following direct trauma or trauma induced by the lower limbs or gravitational microtraumas accompanying and aggravating old age.

Aside from these "general biomechanics" operations, it is also appropriate to be able to restore the postural balance of the body following dizzy spells, operations and gravitational imbalances of various origins and to completely reprogramme the proprioceptive loading patterns of the ankles and knees.

To restore the balance in such a way, recourse is also had to Western and Asian traditional natural methods for obtaining a good balance of the human skeleton, these methods being based on alternate rotations, extensions and flexions from the feet up to the head; such methods are, however, accessible only to the healthy, and are therefore essentially preventive methods, and have to be performed on a conscientious and long-term basis.

Aside from these methods, it has long been proposed that apparatuses for automatically performing the rehabilitation movements be produced.

Thus, as emerges from FR-A-2,561,911, apparatuses for stretching out the spinal column of an individual using the weight of his body have been proposed, the solution described in that document relating to a type of rocking table which allows the patient to be installed in an antalgic position.

A solution of this kind allows the treatment of patients whose intervertebral discs exhibit a compressive pathology, and also allows the stretching of arthritic hips.

It cannot therefore be used in instances where there is the desire also to perform rotational movements, particularly of the pelvis. Furthermore, a rocking table of this kind is tricky to operate and very uncomfortable for the user.

For maintaining pelvic mobility, it has been proposed, as is apparent from FR-A-2,608,057, to produce an armchair comprising a seat part which pivots in a horizontal plane about a vertical axis while the backrest remains fixed with respect to the said seat part.

An assembly of this kind therefore allows the pelvis to be pivoted in one direction or the other with respect to the fixed trunk, it being possible for the amplitude of the pivoting movement to be altered according to the treatment. Furthermore, with such an assembly it is possible to immobilize the seat part and work the joints (ankles, knees) by moving sliding blocks on which the user rests his feet.

While such an installation allows the mobility of the pelvis and of the joints to be maintained, it is not, however, suited to true restoration of balance, which entails mobilizing the skeleton in all three directions in space, with X, Y and Z coordinates.

Swiss patent 328,968, for its part, describes an apparatus comprising two devices for securing the seat of a patient, these devices being mounted on a plate which can move about a horizontal mean position. A first transmission device imparts to the plate a movement of oscillation about its axis and a second device imparts to the plate a movement of oscillation in a surface which is at least approximately in a vertical plane, and does so in such a way that the plate is given a movement which is the resultant of the two oscillatory movements.

An apparatus of this kind is therefore able to impart to a patient's pelvis a combined movement of oscillation both in a horizontal plane and in a vertical plane, the amplitude of the oscillations of the plate in the vertical plane being adjustable prior to use.

Here again, it is not possible to truly restore the balance of the body and what is more, the concrete solution described in that document envisages means which are incompatible with a treatment of restoring the balance of the body. This is because the patient's feet are fixed in "blocks", which may endanger the knees unless the movement imparted to them is infinitely small. The presence of a pelvic strap prevents sacro-iliac mobility. Finally, the corset holding the ribcage may hamper breathing and does not allow the torso to be worked in torsion. What is more, in no way does the apparatus allow treatment in a seated position to be envisaged.

Outside the technical field of rehabilitation proper, it has also been proposed, more specifically for sports training purposes, to produce oscillating plates, which may or may not be motorized, as is apparent in particular from U.S. Pat. No. 2,827,894 and U.S. Pat. No. 4,290,601, it being possible for the amplitude of oscillation to be adjusted prior to use in the former of these documents, and the amplitude of oscillation being preset in the latter.

In the realm of the training of sportsmen, there have also been proposed, as is apparent from U.S. Pat. No. 4,313,603, apparatuses comprising a platform on which the user stands and which can have an alternating rotational movement in a horizontal plane imparted to them, which movement is obtained by means actuated directly by the user.

As with the documents examined hereinabove, the solutions described in these last two documents are also unable to allow the skeleton to be mobilized in all three planes in space, whether this be in a standing, seated or other position, which conditions are essential for truly restoring the balance of the body.

Now, there has been found, and this is what is the subject of the present invention, a new type of mobile platform on which the patient can be held in an upright position, a seated position or some other position, which is of a simple design, easy to operate, multi-functional, and which not only allows the mobility of the pelvis and of the joints to be maintained but also allows balance to be truly restored to the body in that it imposes mobilization in all three planes in space with X, Y and Z coordinates, allowing alternating and rhythmic compression-decompression sequences, adjustable in respect of all parameters, to be performed, such an apparatus being able fundamentally to correct imbalances in the centre of gravity of the human body located in the pelvis.

This imbalance which worsens progressively with age, because of lack of maintenance thereof, leads to the slower hesitant gaits and then the falls which ageing human skeletons experience.

The apparatus according to the invention allows all the operations that the restoring of balance to the entire skeleton entails, namely mobilization of the sacro-iliac joints, of the lumbar spine, of the thoraco-scapulo-cervical complex to be performed effectively.

This is achieved according to the invention by mobilizing the barycenters of regions of the body of seated, standing, bent, three-quarters, etc. subjects in all three planes in space with Z, X and Y coordinates. Such mobilization is achieved by a combination of lateral oscillations, pivoting across the diagonal of the girdles, alternating pelvis/trunk rotations and anterior-posterior oscillations.

All of this muscle/joint activity is brought about automatically by controlled motorization, within the physiological range of movement of the skeleton, and without any intervention on the part of the patient.

If necessary, active work may be done against some resistance in order to improve muscle dynamics.

This apparatus also allows a complete proprioceptive reprogramming of the work patterns of the ankle and knee joints.

It also allows the ankles to be rehabilitated and full range of movement restored. Furthermore, the apparatus according to the invention can be used regardless of the build of the individual.

In general, the apparatus according to the invention, and which allows balance to be restored to the human body, consists of a platform intended to support the subject to be treated and which can have an oscillatory movement imparted to it, and it is characterized in that the said platform is motorized and its oscillatory movement is imparted to it about a central support axis, this movement being combined with a reciprocating rotational movement, the amplitude and speed both of the oscillation and of the rotation being adjustable and capable of being varied during use.

The possibility of adjustment on the one hand allows the user to position himself on the platform while the platform is in a horizontal position and on the other hand allows the amplitude and speed both of the oscillation and of the rotation to be altered according to the treatment that is to be performed, it being possible for these factors to vary in a programmed way during use according to the treatment that is to be performed.

Furthermore, the structure of the apparatus according to the invention also allows the platform to be used in a horizontal plane, the oscillatory movement then being cancelled, and just the rotational movement remaining.

According to one embodiment which allows a wide variety of treatments to be performed, means are associated with this basic platform which allow at least the spinal column of the patient to be kept in a vertical position on the mobile platform.

Furthermore, hand rests are advantageously provided, it being possible for these rests to be arranged, with respect to the patient, either to the side and/or facing him and/or above him, in this last case forming a traction bar.

The hand rests will preferably be adjustable for height. Furthermore, in the case of lateral rests, they may also have a reciprocating horizontal sliding movement imparted to them.

Finally, the apparatus according to the invention is also and preferably associated with means which allow traction to be exerted along the axis of the body if necessary, particularly when the subject is held in a vertical position standing up.

In such a case, these means consist, for example, of a stationary upright in the form of a bracket supporting an element consisting of a chinstrap which allows the subject to be kept in a vertical position while at the same time allowing traction to be exerted along the axis of the body; in such a case, the chinstrap is advantageously fixed to the end of a cable subjected to an adjustable traction force, this force being exerted, for example, using a counterweight which can slide in the vertical support post or any other equivalent means.

By virtue of such an apparatus, it is therefore possible to position the patient on the platform in any configuration, whether this be standing up, crouched down, or even seated.

When the subject is treated in a seated position, a seat is mounted directly on the mobile platform. In such a case, the seat has no backrest and is in the form of a seat of the stool type on which the patient can be positioned either normally, with his legs square in front of him or with his legs to each side, as if he were sitting on a saddle. Such a seat can preferably be orientated by 90° on each side in a horizontal plane and inclined up and down on a vertical axis, it being possible for the amount of inclination to vary, but this inclination advantageously being between 5 and 30°.

The invention and the advantages it affords will, however, be better understood from the embodiment given hereinafter by way of non-limiting indication and which is illustrated by the appended diagrams, in which.

In the remainder of the description, the invention will be described using the apparatus given by way of example with a patient held vertically standing upright, but it could also be used with the patient held sitting down, the only adaptation made to the apparatus according to the invention lying in the fact that a seat on which the patient is seated is mounted on the mobile platform which is the essential element of the invention. In such an instance, the seat would have no backrest, would have a structure such that the patient could sit normally, or astride it. In addition, the said seat would preferably be mounted on a support which was adjustable for height, and could be orientated either to each side in a horizontal plane, or could be inclined up and down.

Figure 1:
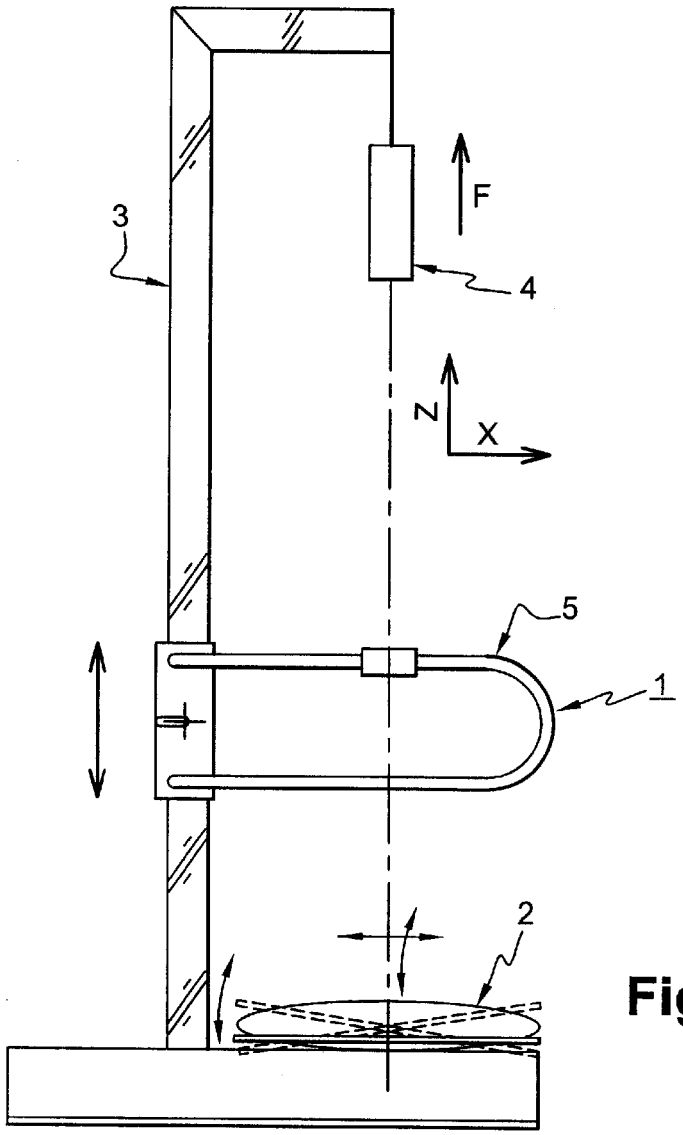
FIGS. 1 and 2 are respectively views in elevation and from above of an apparatus produced according to the invention.
Figure 2:
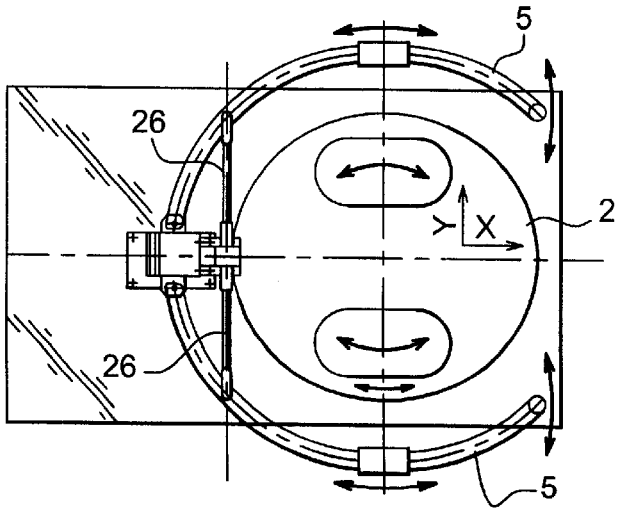
Figure 3:
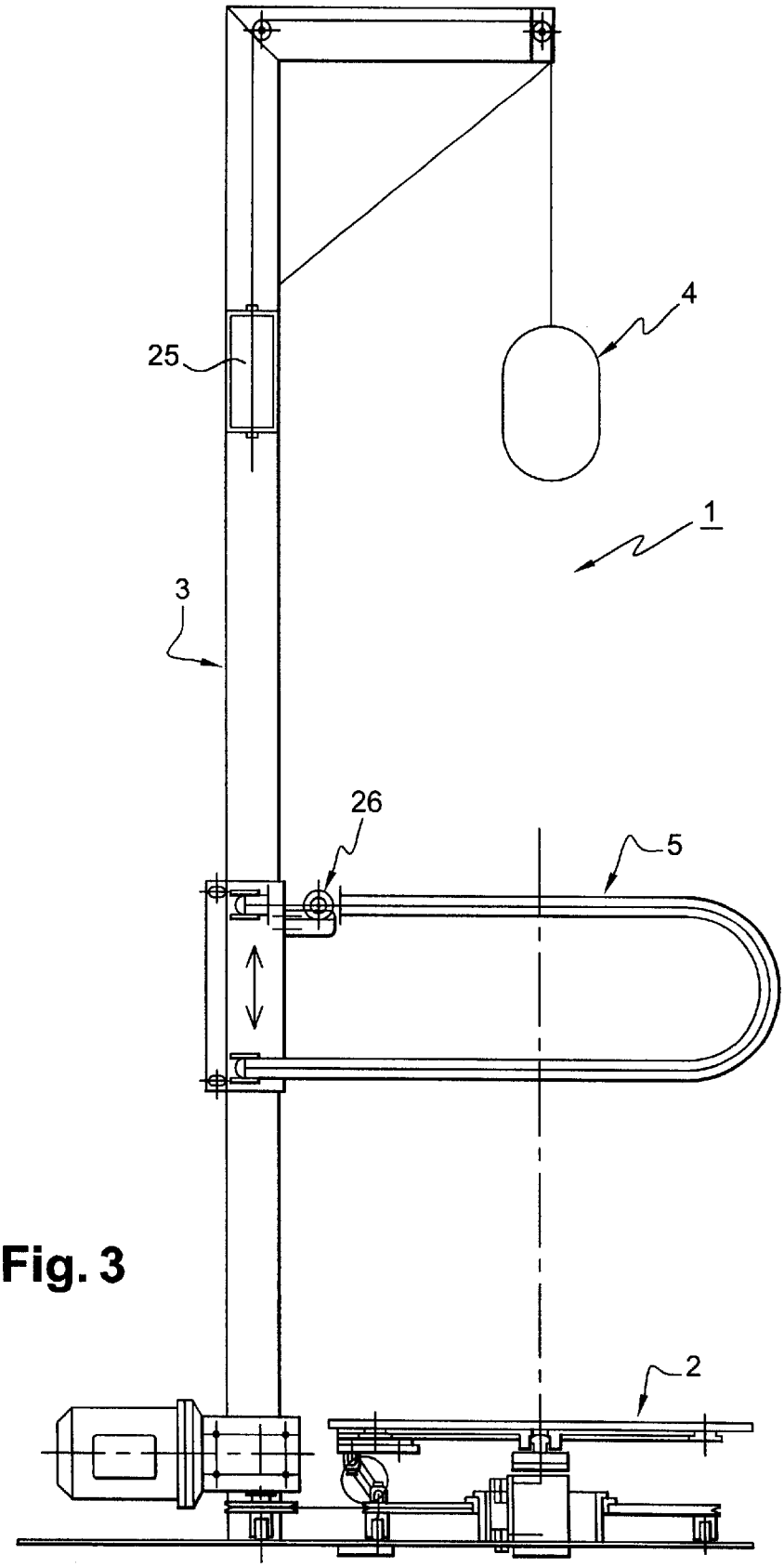
FIG. 3 is a view in elevation from above showing the structure of such an apparatus in greater detail.
Figure 4:
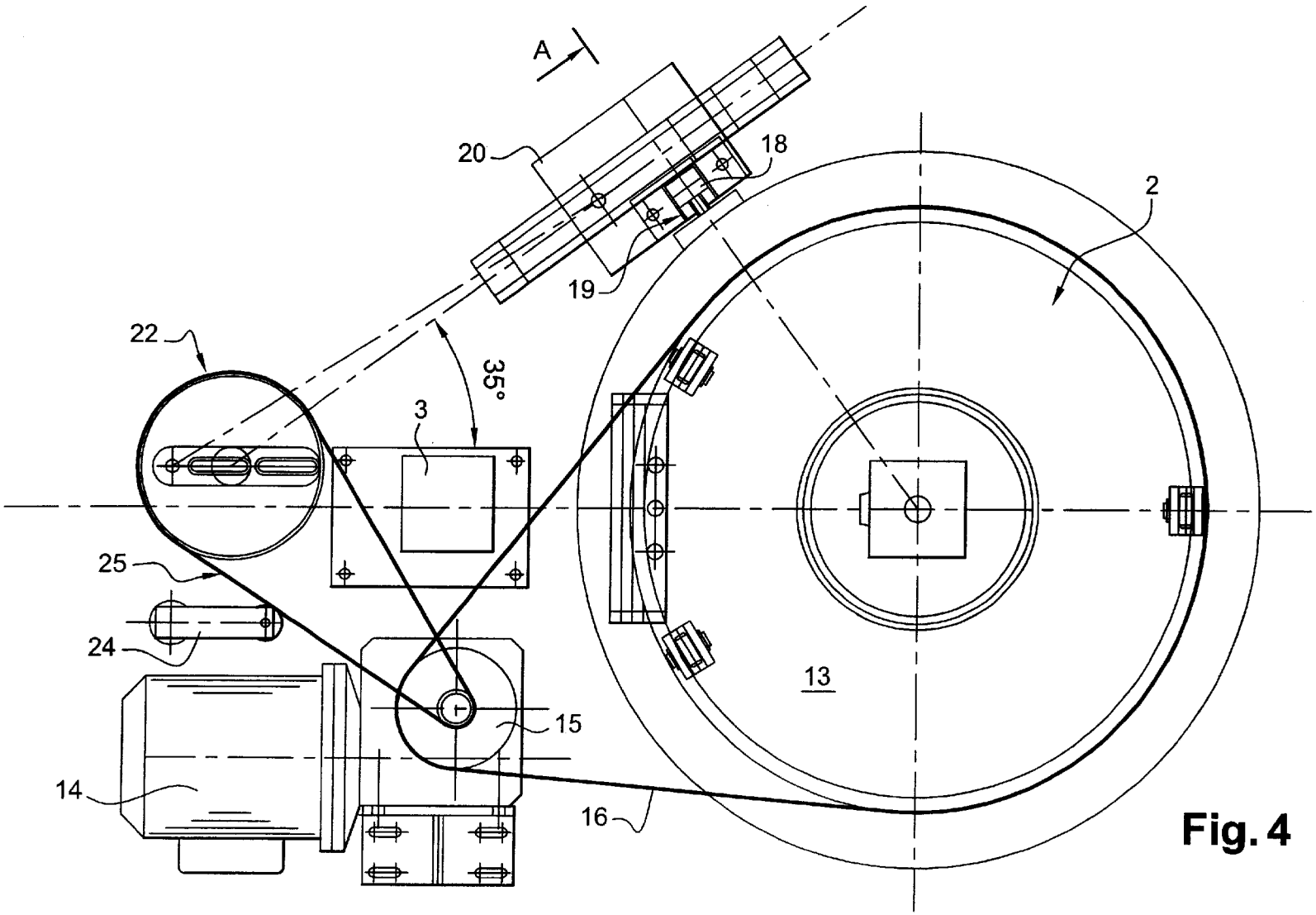
FIG. 4 is a view from above showing the way in which the mobile platform is controlled.

Referring to the appended diagrams and more specifically to FIGS. 1 to 3, the apparatus according to the invention and which is denoted by the overall reference (1) is essentially made up of a motorized platform (2) which serves as a footrest for the patient, this platform having an oscillatory movement about a central support axis, combined with an alternating rotational movement, imparted to it.

Associated with this platform is a stationary upright (3), in this instance in the form of a bracket, which supports an element (4)—a chinstrap for example—which allows the subject to be held in a vertical position on the platform (2) and allows traction to be exerted along the axis of the body if desirable.

In a simple way, and as is apparent from FIG. 3, this traction can be obtained by mounting the chinstrap (4) at the end of a cable subjected to a traction force (F) exerted, for example, by means of a counterweight (25) which can slide in the vertical post (3), to allow the vertical oscillatory movement of the subject's head to be stabilized in synchronism with the oscillation of the platform (2). By way of an indication, a five-kilogram counterweight (25) is appropriate for most patients that are to be treated. Obviously, such a counterweight may be changed to be heavier or lighter than five kilograms. Likewise, any other balancing system could be used.

As stated earlier, the mobile footrest platform (2) has a structure such that it is motorized and may, on the one hand, have an oscillatory movement about a central support axis imparted to it and, on the other hand, have an alternating rotational movement imparted to it, these movements being depicted in FIGS. 1 and 2.

FIGS. 3 to 6 illustrate one embodiment which allows such a combination of movements to be achieved and the way in which their amplitude can be adjusted.

As is apparent from FIGS. 3 to 6, the oscillatory movement, the amplitude of which is adjustable, is obtained by mounting the platform (2) at the end of a central support axis (6) via an assembly which forms a ball joint (7). The support axis (6) of the platform (2) is mounted at the end of the rod (8) of a cylinder actuator (9).

The underside of the platform (2) comprises an annulus (10) against which there bear two rollers (11) driven in rotation about the vertical axis Z, by means of a connecting rod (12) connected to a drive plate (13). The plate (13) is rotated by a motor (14) via a pulley (15) and a transmission belt (16). The drive plate (13) is carried on wheels (17). Moreover, a roller (18) which slides in a vertical lateral slideway (19) is arranged at the periphery of the annulus so as to prevent the plate from rotating and thus obtain the oscillatory movement.

By virtue of such an assembly, it is therefore possible to impart an oscillatory movement to the platform (2) by varying its inclination with respect to the horizontal simply by operating the cylinder actuator.

The amplitude of oscillation will depend on the inclination of the platform (2), which inclination may be by as much as 10°.

Figure 7:
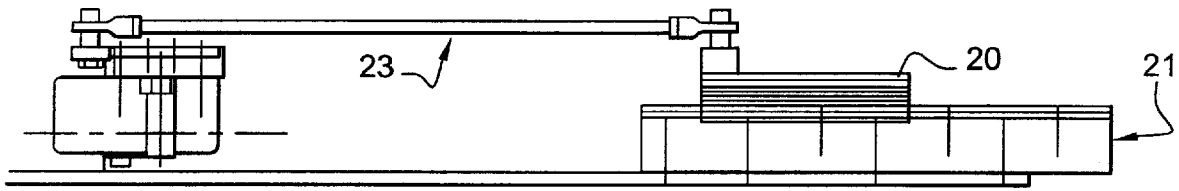
FIG. 7 is a view on B of FIG. 4, showing one way of achieving the alternating rotation of the said support platform.
Figure 6:
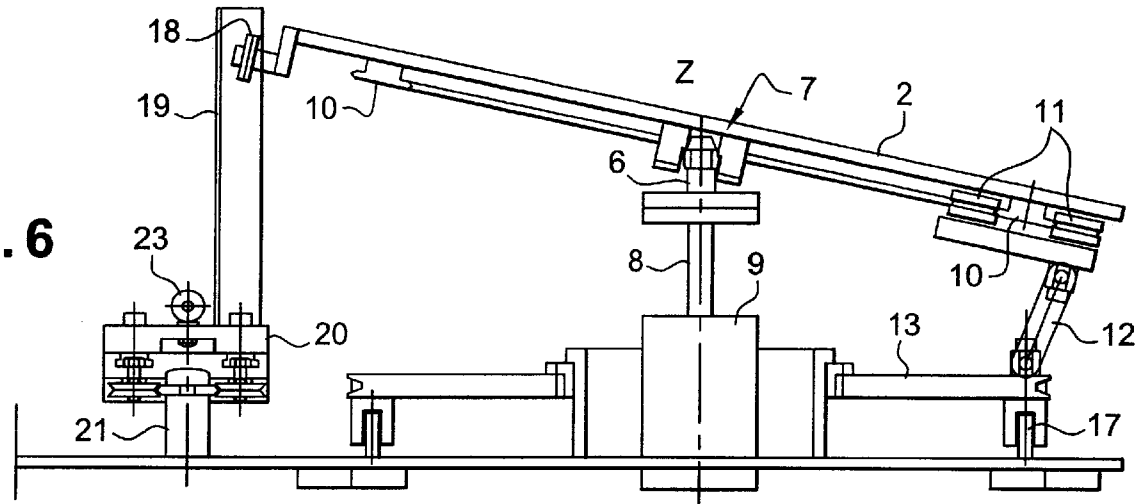
FIG. 6 is a view on A of FIG. 4 showing how the support platform is inclined to allow its oscillatory movement to be imparted to it.
Figure 5:
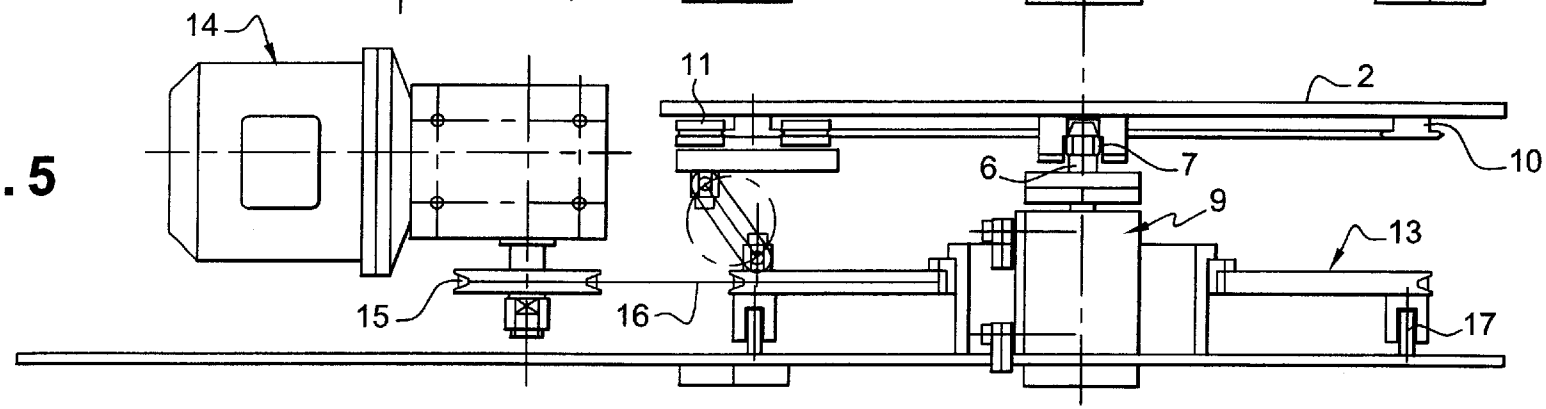
FIG. 5 is a view in elevation of FIG. 4, the platform being shown in its horizontal position.

According to the invention, the platform (2) also has an alternating rotational movement imparted to it. Such a rotational movement is obtained, as is clear from FIGS. 4, 6 and 7, by moving the slideway (19) which guides the roller (18) mounted on the periphery of the platform (2). To achieve this, the slideway (19) is mounted on a support (20) which can slide on a fixed baseplate (21). An eccentric (22) controls a link rod (23).

The eccentric (22) is driven in rotation, for example, by means of the motor (14) via a transmission belt (25) against which a belt tensioner (24) presses. By adjusting the eccentricity, it is possible to vary the amplitude of the alternating rotation of the platform (2). This alternating rotation of adjustable amplitude may be by as much as 30°.

The motor will be a conventional motor, it being possible for its speed to be adjusted either manually, or be programmed, for example to vary during a treatment. While, in general terms, during conventional treatment, the motor always runs in the same direction, it could be envisaged for its direction of rotation to be reversed, with predetermined frequency.

Finally, the apparatus according to the invention comprises lateral rests (5), adjustable for height, to which a reciprocating horizontal sliding movement may be imparted.

In the embodiment illustrated in FIGS. 1 to 3, the lateral rests (5) are semicircular and it is possible to adjust their separation by means of connecting rods (26).

The command for horizontal reciprocating sliding is transmitted from the alternating rotational movement of the footrest platform (2), amplifying it.

Furthermore, the movements of the lateral rests (5) may be slowed down in order to provide resistance against the movement performed by the patient.

Advantageously, the lateral rests (5) are mounted on the post (3).

Finally, additional rests, for example arranged in front of the patient or above him, may be provided.

The alternative form illustrated in FIGS. 8 and 9 comprises a platform (2) driven in a way similar to the way described hereinabove.

The differences essentially lie in the structure of the additional means, and more particularly rests which may be associated with such a platform.

In this alternative form, two vertical portal frames (30) are arranged laterally one on each side of the platform (2) and are mounted at the four corners of the assembly (31) which forms the cover over the said platform and its drive means.

These two portal frames (30) support hand rests arranged to the side of, facing and above the subject.

Likewise, the portal frames may be used for supporting means (not depicted) allowing traction along the axis of the body.

In this form, the lateral rests (32) consist of two telescopic bars, the ends of which can slide along the uprights of the portal frames (30), thus allowing them to be positioned either horizontally or at an angle, also varying the heightwise position of such rests.

Figure 8:
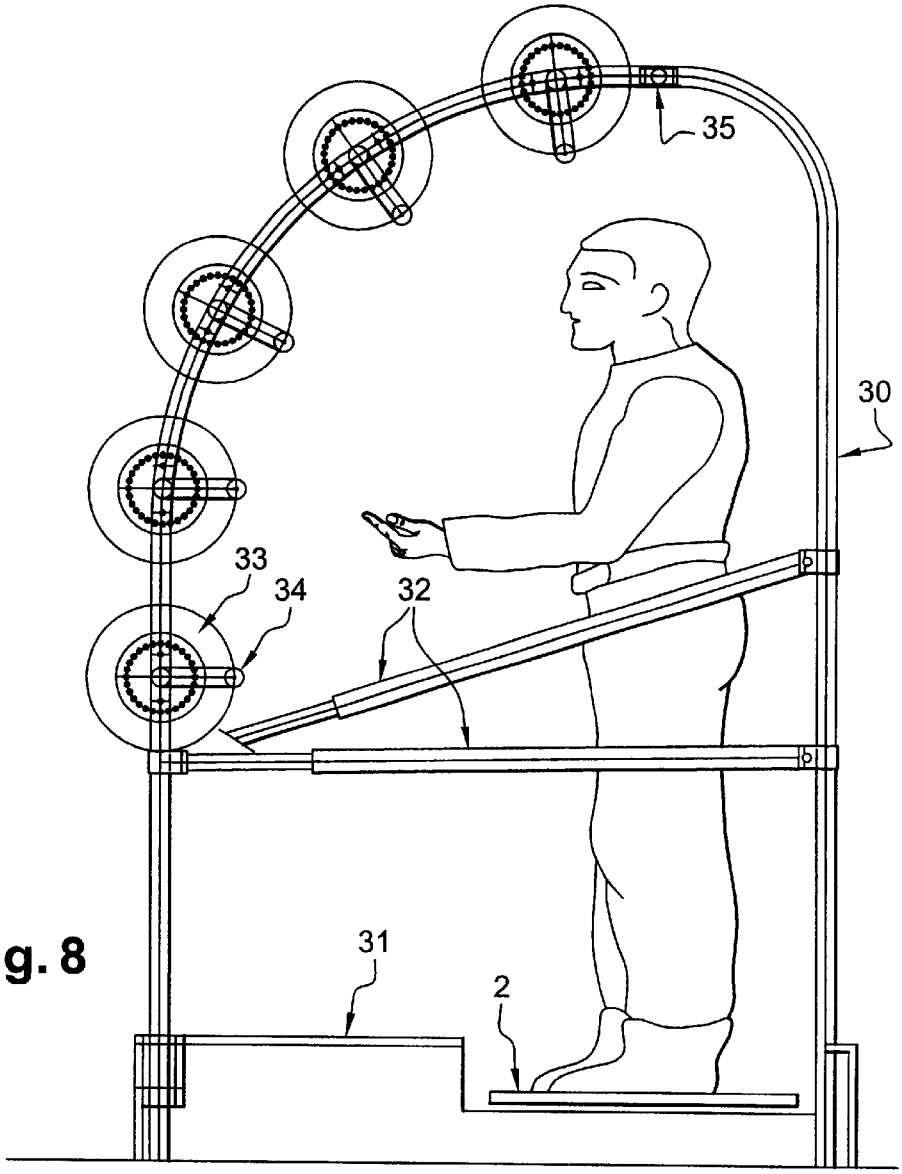
FIGS. 8 and 9 are respectively a side elevation and a view from above of an alternative form of the invention.

The frontal rests (33) depicted only in FIG. 8 are also supported at their ends by the lateral portal frames (30).

They may consist of a single assembly (33) mounted so that it can slide along the uprights of the portal frame (30), which assembly comprises a bar rest (34) which is angularly orientable.

However, as a preference and as depicted in FIG. 8, use will be made of a number of frontal rests (34) arranged at different levels on the uprights of the portal frame (30) and the hand grips (34) of which are pre-orientated with respect to the subject who is to be treated.

Finally, an upper crossbar (35) may also allow means to be attached to allow traction to be exerted along the axis of the body.

Figure 9:
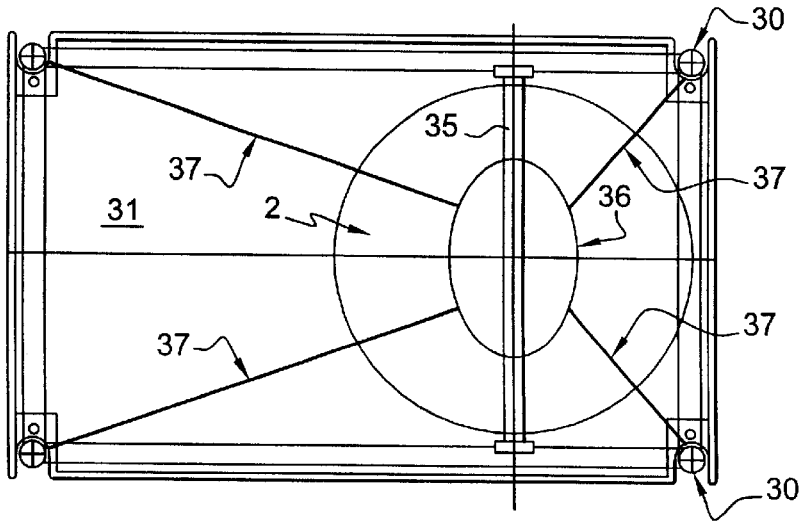

In certain instances where there is a desire to keep the patient in a very specific position on the platform, it is possible, as depicted in FIG. 9, for the platform to be fitted with a belt (36), the belt being, for its part, connected to each of the lateral uprights of the portal frames (30) by links (37) which may or may not be elastic.

The two embodiments of the invention allow balance to be truly restored to the body and for this to be done using all or some of the elements of which they are composed.

Specifically, an apparatus of this kind can be operated either using the platform alone or using the platform with the hand rests, particularly the lateral hand rests, or by using the platform, the hand rests and the oscillating decompression headgear, it being possible for the patient either to be standing up or crouched down or seated on a seat mounted on the platform.

These various modes of operation and the results obtained are summarized hereinbelow.

Use of the Platform Alone

In such a use, with the subject standing upright on the platform, the following effects are therefore obtained:

a) elevating and inclining the platform raises half of the pelvis on one side: vertical axis Z and simultaneous lowering of the other side and also convergence and divergence of the underlying vertebral segments in a transverse plane;

b) rotating the platform causes a rotation+anteversion of half of the pelvis on one side about a transverse axis X at the same time as rotating and posteriorizing the opposite half of the pelvis; and c) inclining the platform changes the angle of half of the pelvis causing a lateral translational movement with respect to a saggital axis Y.

The consequences of this complex three-dimensional movement of the skeleton therefore perform alternating and rhythmic compression/decompression sequences in all three planes in space which manipulates the joints as a whole and can therefore slow down and stabilize, for example, the after-effects of osteoporosis and obtain rehabilitation of the joints and cartilaginous and discal reimbibition.

A combination of movements of this kind also generates motive coherency suited to stimulation.

Furthermore, the pelvis and spinal column are recentred and this balances the pressure of the vertebrae on the sacrum and releases iliac tension leading to a reduction in any pain and an improvement in the gait.

Use of the Platform and of the Lateral Rests

Compared with the embodiment described hereinabove, by resting against the hands and doing so at different heights, it is possible to obtain a wide variety of positions in which to fix the part of the body and scapulum locating and propagating the effects of mobilizing the pelvis and weight-bearing portion at the various stages along the spine and in all the anatomical and mechanical positions, thus optimizing the release of trunk/pelvis mobility.

The lateral rests also make it possible to lighten or increase the underlying mechanical stresses.

Use of the Platform, the Lateral Rests and the Oscillating Decompression Headgear The use of an oscillating decompression headgear (4), free in all three planes in space, allows the head to be kept vertical or decompressed slightly to accompany the movements induced by the platform.

It is thus possible to assist with centring access to the body of subjects who are very poorly orientated in space and also cause the cervicoscapular muscles to relax. Visual markers may possibly be positioned in front of the subject, thus allowing postural imbalance to be addressed through a visual postural input. In such an instance, the hand rests are the means of coordinating the fundamental movements of dynamics and human propulsion as crossed sequences of movements of the shoulder and pelvic girdles.

Use in the Seated Position

Aside from the uses examined hereinabove in the case of a subject kept in a standing position, it may be possible to use such an assembly in a seated position. In this instance, a seat without a backrest, orientable by 90° on each side in a horizontal plane and inclinable by 5 to 30° upwards and downwards on a vertical axis will be mounted on the platform.

A modification of this kind makes it possible to choose to carry out postural rehabilitation work in a seated position, particularly on those who have injuries to the lower limbs. This also allows the work on the spinal column to be selective within this frame of reference and makes it possible to open up the space between the processes of the vertebrae, which space characterizes each joint of the spine, this vertebra with its three processes being the fundamental element and basic unit of the spinal column.

In a use such as this, numerous parameters could possibly be adjusted, namely the adjustable height, the amplitude of rotation, the anterior and posterior inclination of the seat, the position in which the upper limbs are rested, and possibly the use of the reference headgear.

An assembly such as this, of particularly simple design, can be used not only for rehabilitation but also to prepare and balance the skeleton for vertebro-therapy care, chiropracty, osteopathy or the like, before or after the sessions, to stabilize the results.

It may possibly be used in the realm of sport as a training device.

What is claimed is:

1. Apparatus for restoring the balance of the human body, comprising a platform (2) intended to support a subject to be treated and which is adapted for oscillatory movement, said platform being operatively connected to a motor, said motor being adapted to cause said oscillatory movement of said platform about a central support axis (6), said oscillatory movement being combined with a reciprocating rotational movement, an amplitude and a speed of the oscillation and the rotation being adjustable and variable during use, and comprising means for holding the subject on the platform either in a standing position or in a crouched or a seated position.

2. Apparatus according to claim 1, characterized in that the means for keeping the subject in a seated position consist of a seat mounted directly on the mobile platform, this seat having no backrest and comprising a stool on which the patient can be positioned either normally, with his legs square in front of him or with his legs to each side, as if he were sitting on a saddle.

3. Apparatus according to claim 2, characterized in that the rests are lateral rests adjustable for height.

4. Apparatus according to claim 3, characterized in that a reciprocating horizontal sliding movement is imparted to the lateral rests.

5. Apparatus according to claim 2, characterized in that it comprises rests arranged facing or above the subject.

6. Apparatus according to claim 1, characterized in that it comprises means for allowing traction to be exerted along the axis of the body.

7. Apparatus according to claim 6, characterized in that the means for allowing traction to be exerted along the axis of the body consist of an element (4) made up of a chin strap fixed to the end of a cable subjected to a tractile force.

8. Apparatus according to claim 1, characterized in that the means for keeping the subject in a seated position consist of a seat mounted directly on the mobile platform, this seat having no backrest and being in the form of a seat of the "stool" type on which the patient can be positioned either normally, with his legs square in front of him or with his legs to each side, as if he were sitting on a saddle.

9. Apparatus according to claim 8, characterized in that the seat can be orientated by 90° on each side in a horizontal plane and inclined up and down on a vertical axis.

10. Apparatus according to claim 2, characterized in that it comprises means for allowing traction to be exerted along the axis of the body.

11. Apparatus according to claim 3, characterized in that it comprises means for allowing traction to be exerted along the axis of the body.

12. Apparatus according to claim 4, characterized in that it comprises means for allowing traction to be exerted along the axis of the body.

13. Apparatus according to claim 5, characterized in that it comprises means for allowing traction to be exerted along the axis of the body.

* * * * *

UNITED STATES PATENT AND TRADEMARK OFFICE

CERTIFICATE OF CORRECTION

PATENT NO. : 6,558,304 B1
DATED : May 6, 2003
INVENTOR(S) : Bardon et al.

It is certified that error appears in the above-identified patent and that said Letters Patent is hereby corrected as shown below:

Column 8,
Lines 23-29, delete all of existing claim 2 and replace with:
-- Apparatus according to claim 1, characterized in that it comprises hand rests. --
Lines 44-50, delete all of existing claim 8 and replace with:
-- Apparatus according to claim 1, characterized in that the means for keeping the subject in a seated position consist of a seat mounted directly on the mobile platform, this seat having no backrest and comprising a stool on which the patient can be positioned either normally, with his legs square in front of him or with his legs to each side, as if he were sitting on a saddle. --

Signed and Sealed this

Second Day of September, 2003

JAMES E. ROGAN
*Director of the United States Patent and Trademark Office*